US005754983A

United States Patent [19]

Landers

[11] Patent Number: 5,754,983

[45] Date of Patent: May 26, 1998

[54] SPORT CAP AND METHOD FOR ITS PRODUCTION

[76] Inventor: Luke Evan Landers, 1689 Benedict Ave., Claremont, Calif. 91711

[21] Appl. No.: 784,055

[22] Filed: Jan. 17, 1997

[51] Int. Cl.[6] ..... A42B 1/06

[52] U.S. Cl. ..... 2/195.1; 2/10

[58] Field of Search ..... 2/183, 195.1, 195.2, 2/195.3, 195.6, 10

[56] References Cited

U.S. PATENT DOCUMENTS 5,428,843 7/1995 Clowers et al. ..... 2/195.2

*Primary Examiner*—Diana Biefeld

*Attorney, Agent, or Firm*—Notaro & Michalos P.C.

[57] ABSTRACT

A sport cap (10) has a visor (16) made of thick-walled neoprene foam rubber. The pattern of the visor (16) is approximately crescent-shaped and has an arched inner edge (24), which is sewed to the head-band (14) in straight stretched form. When in a used position the visor (16) has a middle convex curvature section (32) and two lateral adjacent concave curvature sections (34), whereby there is a uniform transition between each of the curvature sections. Due to this multiple curvature of the visor (16), the visor has a form stability when in use but is at the same time soft and pliable. The cap (10) with visor (16) can be transported while crushed together in any form desired. The visor (16) will always return to its original form once the cap is placed on the head.

6 Claims, 6 Drawing Sheets

SPORT CAP AND METHOD FOR ITS PRODUCTION

FIELD AND BACKGROUND OF THE INVENTION

The invention refers to a sport cap consisting of a cap preferably made up of several textile segments which have been sewn together, a head-band which is essentially inelastic and has a loose upper edge and a lower edge as well as a visor whereby the inner edge of the visor is sewn between the edge of the cap and the bottom edge of the head-band.

Sport caps of this type are known as so-called visor caps. The visor is made of a stiff elastic pliable thin material which is usually synthetic and has a thickness of less than 1.0 mm. There are also visors made of cardboard which are then covered with cap material. If the visor of well-known sport caps is to have a good form stability, the stiffness is so great that it has only limited pliability. In a situation of impact stress the visor will bend or even break. In sport games involving balls these types of caps can even cause head injuries.

SUMMARY OF THE INVENTION

It is the task of this invention to design a cap as described in the beginning paragraph which has a good form stability when in use, i.e. when positioned on the head, but which can be folded tightly together in the smallest size possible without any damaging effects to the visor once the cap is unfolded and used the next time.

This task has been solved in that the basic invention idea is to design a visor made of a plate-shaped, elastic deformable foam rubber pattern with a thickness of at least 3 mm, that the visor with the joining cap part and head-band can be laid out flat in an unburdened condition, whereby wrinkles (folds) are formed on the cap part and the head-band which run essentially perpendicular to both head-band edges and spread out gusset-like from the upper to lower edge of the head-band. And that the visor has an approximate crescent-shape when in a flat position and its inner edge is curved to an arched form whereby the curvature is greatest in the middle range gradually minimizing towards the end of the inner edge.

A further design of the invention is that the inner edge of the visor has at least an approximate parabolic form.

An especially advantageous characteristic of this invention lies in the fact that when seen from the front, with the head-band straightened out, the visor forms, top-side, a middle convex curvature section and two laterally joining concave curvature sections. The convex curvature section preferentially converges uniformly into the concave curvature section.

Based on the invention the visor is cut out or punched out of a normal neoprene foam rubber plate. The visor pattern is crushable any random number of times and always returns to its original smooth form without leaving any traces of fold or wrinkle marks. Once the cap is placed on the head, as seen from the top, the central visor range gets a convex curvature, in such a way that the front edge of the visor is curved to an arch form.

This gives the visor a sufficiently high form stability but it remains pliably elastic so that at impact or hitting against a resistance it can flip up or downwardly without causing any injury to the head of the wearer. This is of essential importance when a sport ball hits the cap. Once the stress impact on the visor ceases, the visor springs back to its arched original position. Especially advantageous for the form stability of the visor is when on both sides of the convex middle curvature section a concave curvature section each is joined. By doing this a double arch of the visor is created which increases the form stability. Both of the lateral concave curvature sections have less of a curvature than the middle convex curvature section and the side edges of the visor run out to the inner edge of the visor almost in a straight line.

Although the visor as described in the invention can have an especially long length, i.e. stretching out a long distance from the front of the head, it cannot collapse due to its curvature. The sport cap can be crunched together into a very small package-size and put into a trouser pocket for example without leaving any folds or creases when the cap is placed on the head. The form stability of the cap is practically unlimited when on the head. The neoprene foam rubber material also has the advantage of being absolutely water resistant making it especially suitable for all types of outdoor sports.

The procedure for manufacturing based on the invention description consists of punching or cutting out of a roughly crescent-shaped visor from a neoprene foam rubber plate of at least approximately 3 mm thick and the sewing on of the inner edge of the visor between the edge of the cap and the head-band. While sewing the visor, it is especially important that the inner edge, at least in certain spots, is stretched out straight when wavy-type deformation of its outer edge appear.

Preferably the sewing-on procedure should be done in two steps, whereby the sewing should be started in the middle and the first half, up to the end of the inner edge of the visor, is sewed on to the head-band. Then afterwards the other half is sewn on the same way starting from the middle point.

The cap form is not important for the invention based cap. The head-band is preferably designed as a closed ring whose circumference can be fitted to individual head sizes, however the head-band could also have a spring clip insert. Preferably the cap is made of a number of material segments put together, although this is not absolutely required.

The cap could shrink to a thin top strip which is stretched across the head from one side of the head-band to the other. But even without this top strip the visor can be easily used, e.g. simply with a head-band.

BRIEF DESCRIPTION OF THE DRAWINGS

The invention is described in detail using drawings in which an example cap is explained.

In the Drawings.

DESCRIPTION OF THE PREFERRED EMBODIMENT

Figure 1:
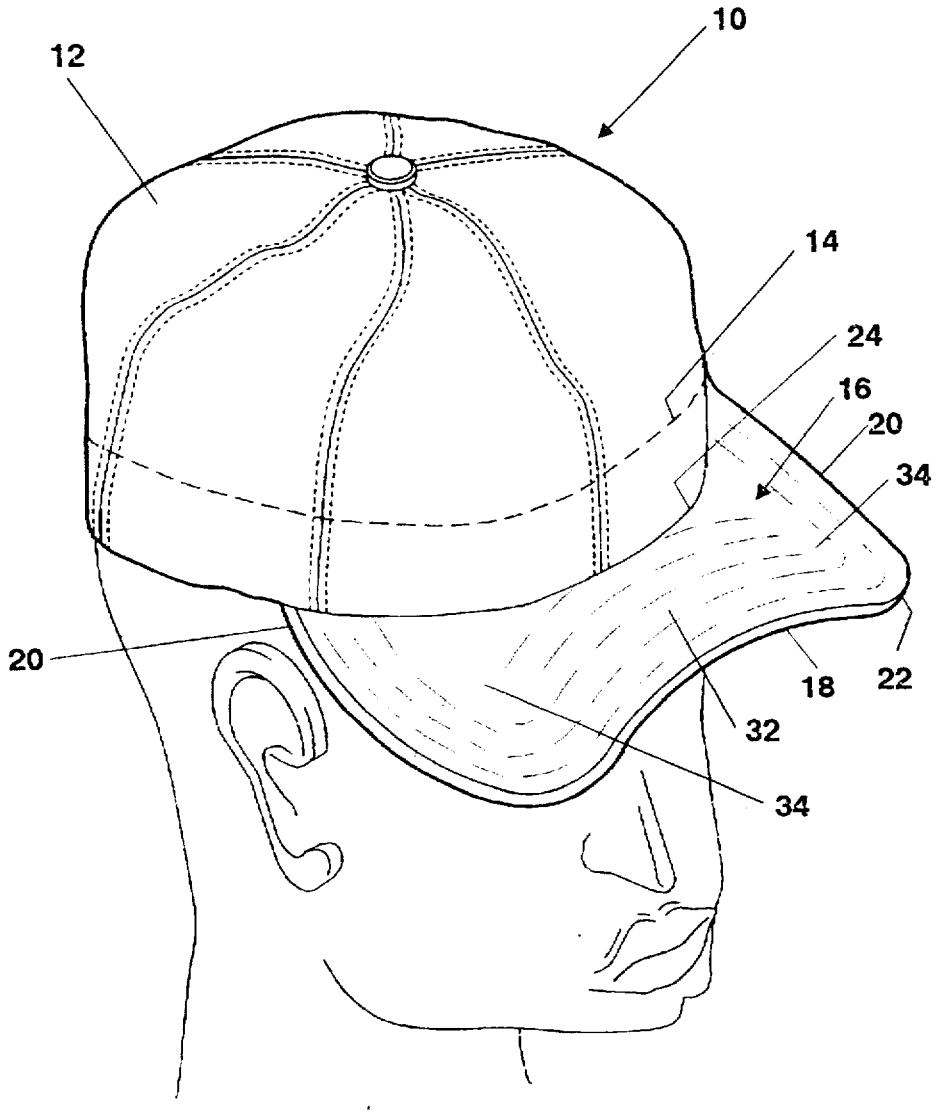
FIG. 1 is a view of the new sport cap placed on the head.
Figure 2:
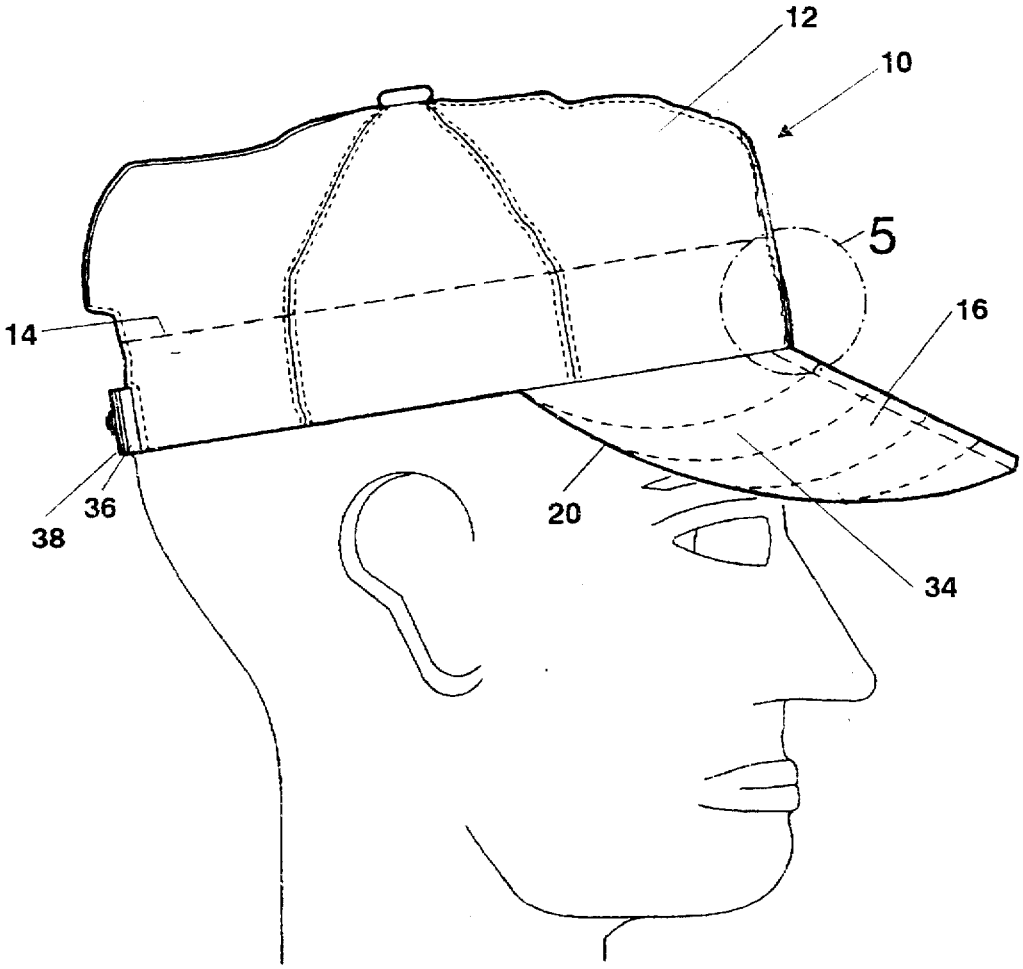
FIG. 2 is a side view of the sport cap.
Figure 5:
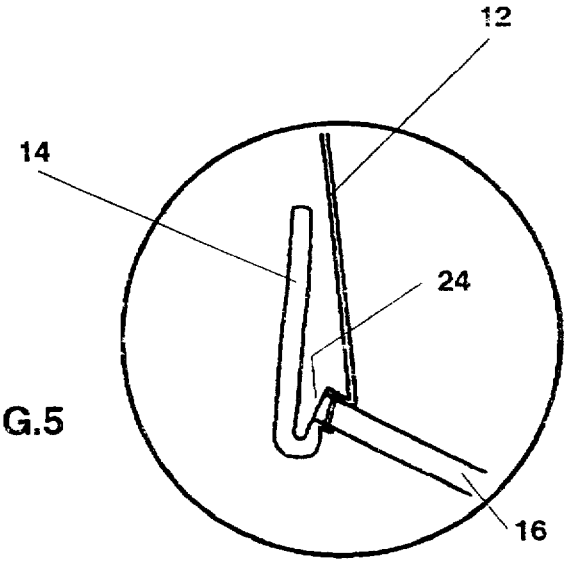
FIG. 5 is a detail section which has been circled at 5 in FIG. 2.
Figure 3:
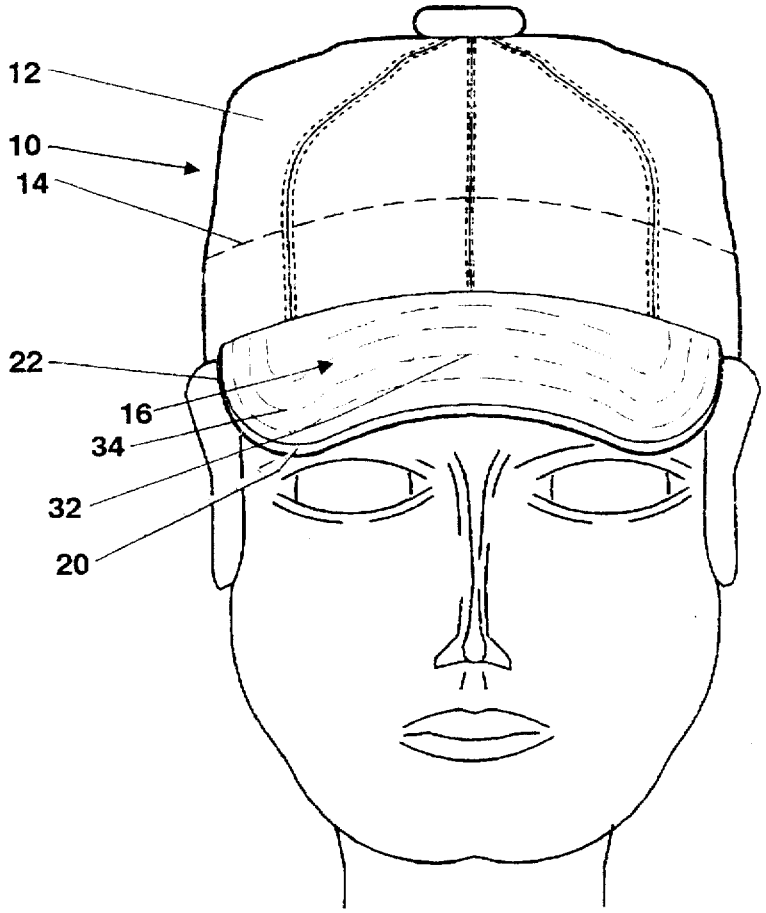
FIG. 3 is a front view of the sport cap.

A sport cap consists of a cap 12 with inward layed head-band 14 and a visor 16. At first observation the visor 16 is made of a crescent-shaped neoprene foam rubber of about 5 mm thickness and has a slightly curved front edge 18, almost straight or slightly convex curved side edges 20 as well as an arched form transition section 22, each between the front edge 18 and the side edge 20. The inner edge of the visor 16 is shown as 24. The length of the visor 16 at its middle width between front edge 18 and inner edge 24 is at least double as large as the length of this side edge 20. The inner edge 24 of the visor 16 is sewed on between the lower edge of the cap 12 and the bottom edge 44 of the head-band 14.

The inner edge 24 of the visor 16 is approximately parabolic in form in flat layed out condition, i.e. the inner edge 24 has its greatest curvature at the vertex and this curvature gradually minimizes as it approaches both ends of the inner edge 24. When sewing the inner edge 24 to the head-band 14 and preferably to the cap 12 at the same time the inner edge is stretched out, i.e. pulled straight and sewed on to the head-band 14 which has also been pulled straight. The visor 16 take on the forms as shown in FIG. 6–9, whereby, as seen from the top, a middle heavy convex arched curvature section 26 and heavy concave arched curvature sections 28 adjacent to each side are created.

The middle curvature section 26 has a straight lined contour 30 in the side view. (FIG. 8) The stretching out of the inner edge 24, i.e. the straightening of this during sewing on of the visor 16, is essential for the form stability of the visor 16 in its later usage function.

If the cap is stretched in its longitudinal direction the visor 16 takes on a form of almost simple curvature, i.e. cuts laid parallel to inner edge 24 have contours which can almost be called drop-shaped forms. Cuts laid out perpendicular run almost in a straight line. Only towards the ends of the side edges are there slight inward curvatures of the outer edges of the visor 16.

In the usage position of the cap 10 the visor 16 takes on a form which lies between that of the longitudinal stretch and the cross stretch of the cap. The inner edge 24 is pulled evenly in radial direction, by which the visor 16 gets a middle convex curvature section 32, whose curvature radius is larger than that of the curvature 26 when cross stretching of the inner edge 24. The front edge 18 of the visor in this curvature section 30 has an arch-form with almost constant curvature.

On both sides of the middle curvature section 32 a slightly concave arched curvature section 34 is joined which in its curvature is much less pronounced than the lateral curvature section 28 in the cross stretched form of the inner edge 24. The curvature sections 32,34 converge completely uniformly into one another. This combination of heavy front convex curvature in connection with a weaker lateral concave curvature leads to an extreme form stability of the visor 16 when the cap is being worn on the head. The form of the visor 16 is renewed each time it is put on and does not lose its form at any time during the duration of usage.

The cap 10 with its visor 16 can be packed tightly together, e.g. rolled, folded, and crushed uncontrollably and can remain in this condition for any amount of time and the visor 16 will still take on its smooth curved form once the cap 10 is placed on the head again. The appearance and the function of the cap remain unchanged.

To adjust the head size the head-band 14 is divided in the back and has 2 belt-like attachment ends 36,38 which have holes and/or anchor pins.

The pattern of the visor 16 made of neoprene material has a slightly curved front edge 18 and almost straight side edges 20 whereby the visor width measured between the side edges gets somewhat smaller towards the front edge 18. The arched radius of the transition arch 22 is smaller than that of the front edge 18.

Figure 4:
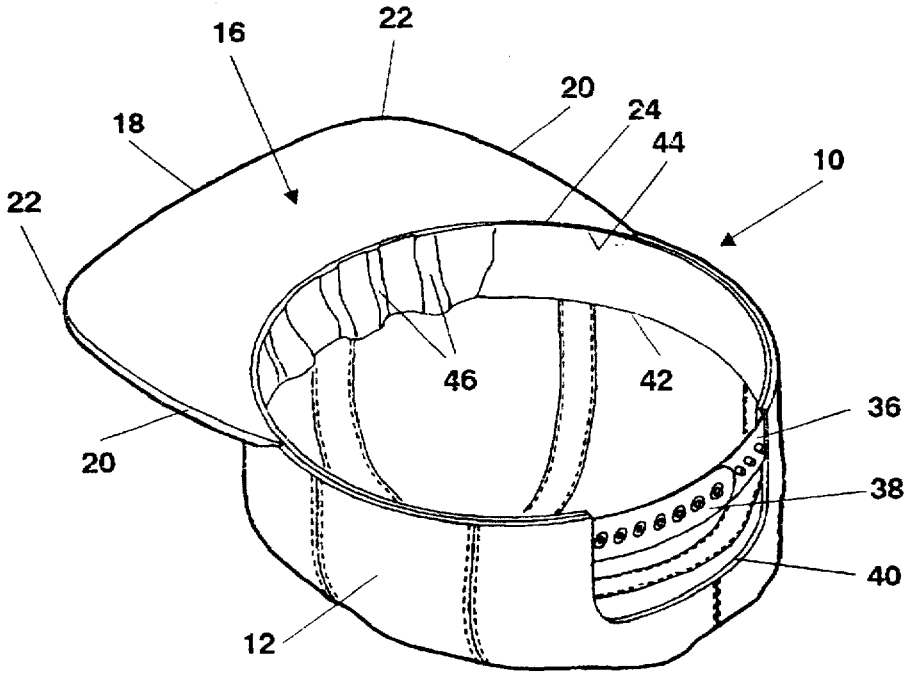
FIG. 4 is a view of the cap from the underside.
Figure 6:
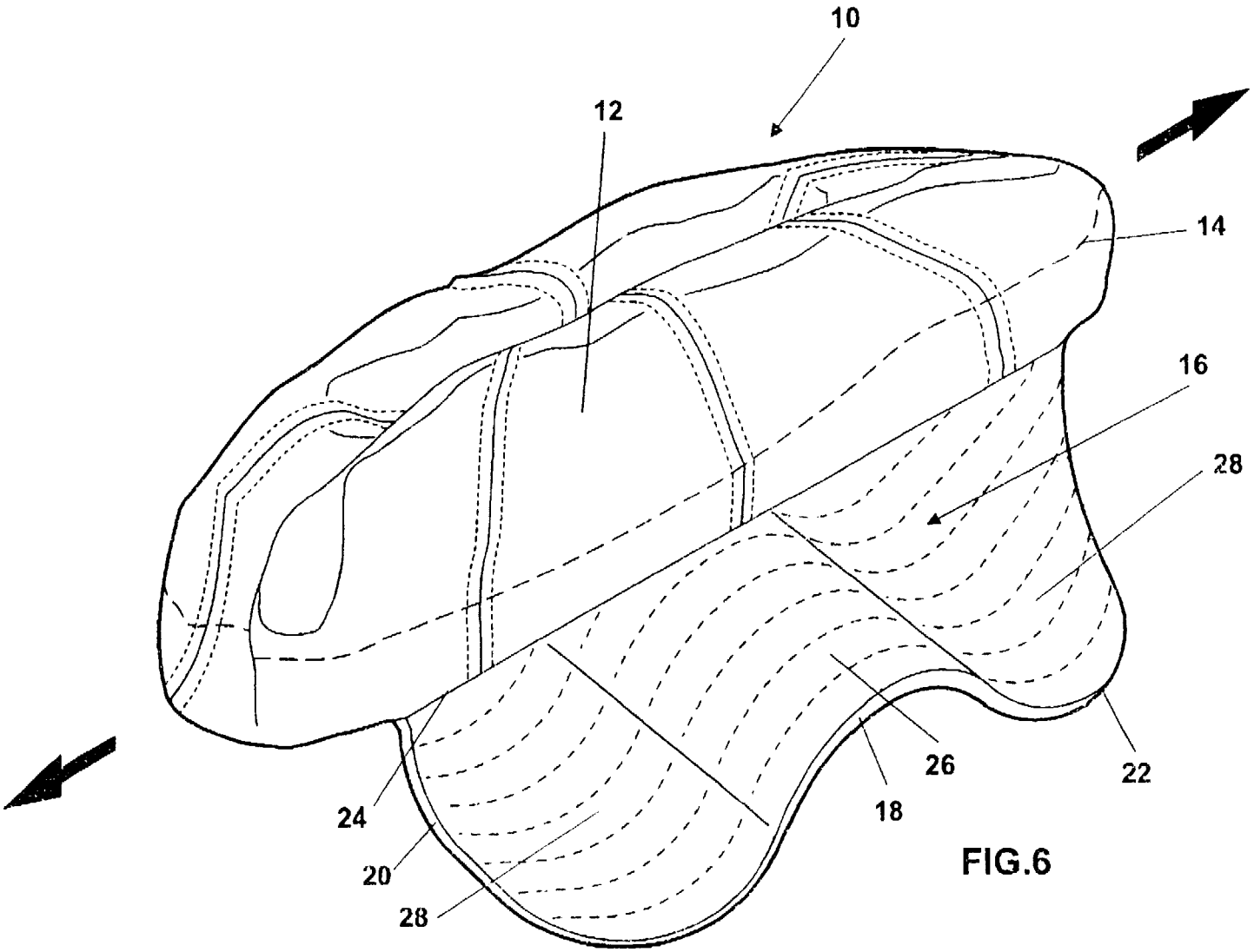
FIG. 6 is a view of the form the visor takes on when stretching the inner edge of the visor in the head-band area.
Figure 7:
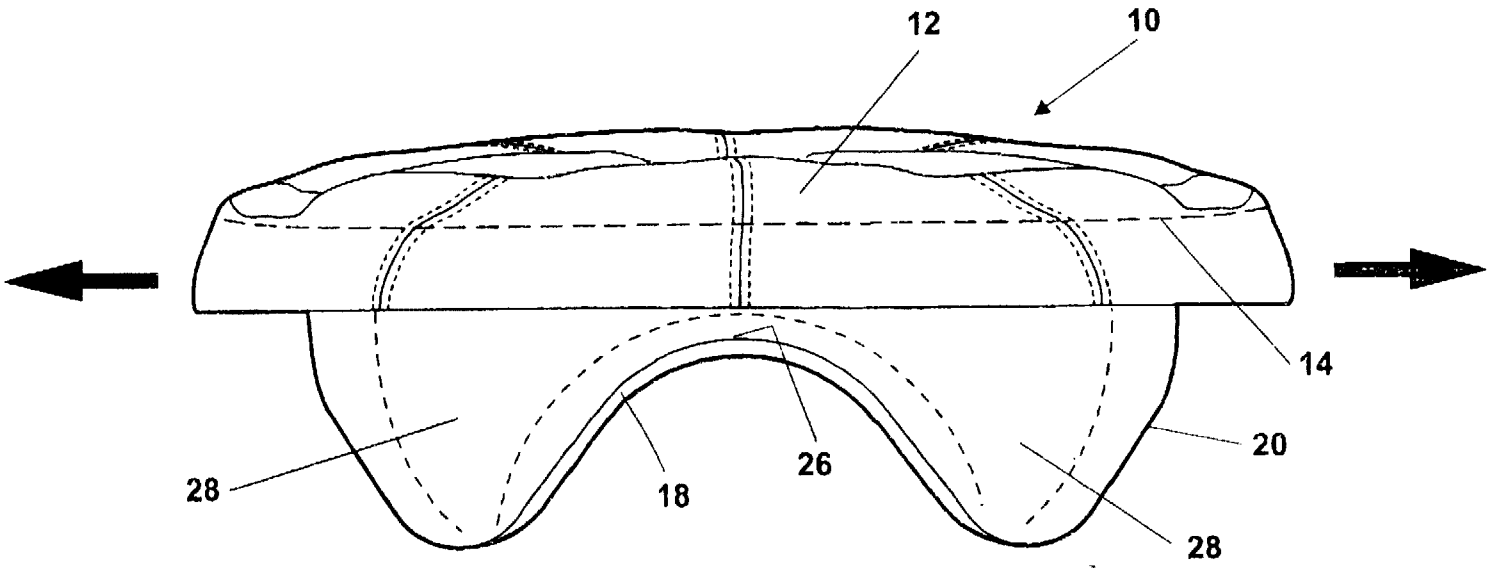
FIG. 7 is a front view of the visor form created when stretching the visor inner edge.
Figure 8:
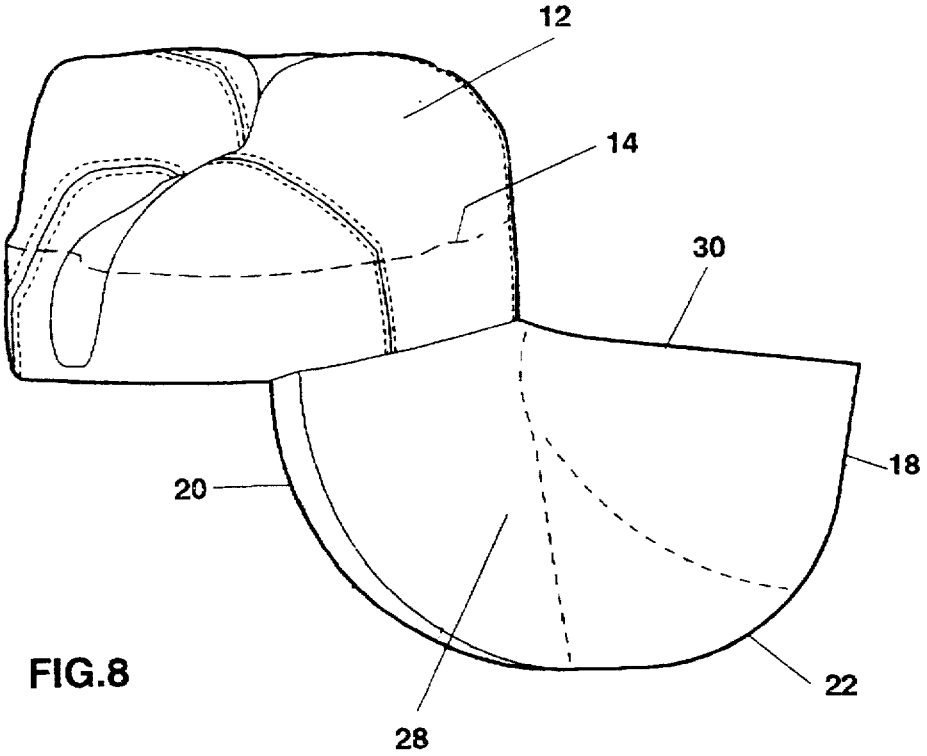
FIG. 8 is a side view of the visor with stretched visor inner edge.
Figure 9:
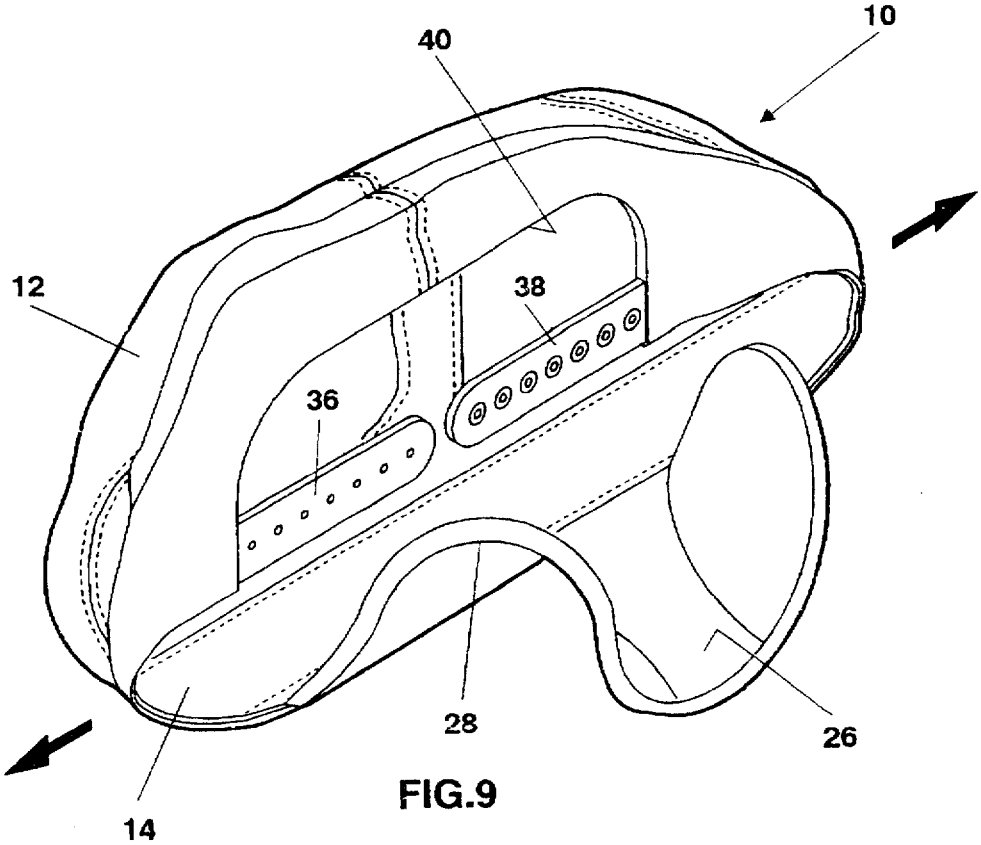
FIG. 9 is an underside view of the cap with stretched visor inner edge.

The head-band 14 has a loose upper edge 42 and a bottom edge 44 which has been sewn to the inner edge 24 of the visor 16. Folds are formed between edges 42 and 44 whereby the straight-lined sewed inner edge 24 of the visor 16 results in these folds spreading out like gussets from bottom edge 44 to upper edge 42. In stretched out condition of the inner edge 24 the head-band 14 the head-band will flow free of folds. These folds 46 which are caused by the elastic initial stress of the visor 16 also appear when the head-band 14 is raised somewhat perpendicular from the flat-lying visor 16. These folds disappear, however, when the cap 10 is placed on the head because the upper edge 42 is stretched which leads to the multiple curvature form of the visor 16. As shown in FIG. 4, in a stress-free, off-head position for the sport cap, the head-band 14 has folds 46 which extend from the lower edge 44 thereof, to the upper edge 42 thereof, and the visor or peak 16 is substantially flat.

I claim:

1. A sport cap comprising: a cap (12) with a lower edge; an essentially inelastic head-band (14) which has a loose upper edge (42) and a lower edge (44); and a peak (16) made of a plate-shaped, elastic deformable foam rubber material with a thickness of at least 3 mm, said peak (16) having at least approximately a crescent-shape in a normal use position and an inner edge (24) being curved in an arched form, whereby the curvature in a middle range of the inner edge (24) is greatest and gradually reduces toward outer ends of the inner edge (24), said peak (16) being sewn between the lower cap edge and the lower edge (44) of said head-band, said head-band having folds (46) which extend from the lower edge (44) to the upper edge (42) of the head-band in a stress-free off-head position for the cap, and the peak (16) being substantially flat in the stress-free off-head position.

2. The sport cap of claim 1, wherein the inner edge (24) of the peak has, at least approximately, a parabolic form.

3. The sport cap of claim 1, wherein the peak (16), as seen from a front of the cap, bends to form a central convex curvature section (26) and two lateral adjacent concave curvature sections (28) when the head-band (14) is pulled straight.

4. The sport cap of claim 3, wherein the convex curvature section (26) has a uniform transition into the concave curvature sections (28).

5. The sport cap of claim 3, wherein the outer edge (18–22) of the peak (16) has a front edge (18) and two connecting side edges (20) with transition arches (22) and wherein the side edges (20) of the concave curvature sections (34) at least approximately run in a straight line near the inner edge (24).

6. The sport cap as claimed in claim 1, wherein the elastic deformable foam rubber is neoprene.

* * * * *